US006936105B2

(12) United States Patent
De Vroome

(10) Patent No.: US 6,936,105 B2
(45) Date of Patent: Aug. 30, 2005

(54) APPLICATOR ROLLER HAVING A ROLLER JACKET, APPLICATOR ROLLER AND ROTATING ELEMENT ASSEMBLY, DRYER, COOLING ROLLER STAND AND PRINTING PRESS HAVING THE APPLICATOR ROLLER AND METHOD FOR COATING A MATERIAL WEB

(75) Inventor: Clemens Johannes Maria De Vroome, BB Beugen (NL)

(73) Assignee: Goss Contiweb B.V., Boxmeer (NL)

( * ) Notice: Subject to any disclaimer, the term of this patent is extended or adjusted under 35 U.S.C. 154(b) by 73 days.

(21) Appl. No.: 10/402,813

(22) Filed: Mar. 28, 2003

(65) Prior Publication Data

US 2003/0183099 A1 Oct. 2, 2003

Related U.S. Application Data

(60) Provisional application No. 60/370,194, filed on Apr. 5, 2002.

(30) Foreign Application Priority Data

Mar. 28, 2002 (DE) ..... 102 13 985

(51) Int. Cl.[7] ..... B05C 1/08

(52) U.S. Cl. ..... 118/264; 118/244; 118/259; 118/DIG. 14; 118/DIG. 15; 101/367

(58) Field of Search ..... 101/367, 349, 101/147; 118/244, 259, 264, DIG. 14, DIG. 15; 492/30, 32, 37; 427/429; 156/578; 15/256.5

(56) References Cited

U.S. PATENT DOCUMENTS

| | | | | |
|---|---|---|---|---|
| 2,217,552 A | * | 10/1940 | Horton | 401/292 |
| 3,656,200 A | * | 4/1972 | Riley, Jr. | 15/97.1 |
| 3,923,936 A | * | 12/1975 | Davis et al. | 264/415 |
| 4,188,882 A | | 2/1980 | Jeschke et al. | |
| 5,332,472 A | * | 7/1994 | Cutright et al. | 162/139 |
| 5,523,123 A | | 6/1996 | Ginzburg et al. | |
| 5,953,584 A | | 9/1999 | Lim et al. | |
| 6,264,743 B1 | | 7/2001 | Cucuzza | |

FOREIGN PATENT DOCUMENTS

| | | |
|---|---|---|
| DE | 29 34 005 A1 | 3/1981 |
| DE | 197 43 741 A1 | 4/1998 |
| DE | 199 57 453 C1 | 2/2001 |

* cited by examiner

*Primary Examiner*—Laura Edwards
(74) *Attorney, Agent, or Firm*—Laurence A. Greenberg; Werner H. Stemer; Ralph E. Locher

(57) ABSTRACT

An applicator roller includes a roller jacket having an outer cylindrical surface for picking up a liquid and, at least to some extent, for transferring the liquid. The roller jacket is formed with at least one perforation through which excess liquid is guidable into a hollow interior of the applicator roller. An assembly of an applicator roller and a rotating element disposed downstream therefrom in a liquid travel direction, a cooling roller stand integrated into a dryer and having the applicator roller, a cooling roller stand disposed immediately downstream from a dryer and having the applicator roller and a printing press having the applicator roller, are also provided. A method is provided for coating a material web.

9 Claims, 15 Drawing Sheets

APPLICATOR ROLLER HAVING A ROLLER JACKET, APPLICATOR ROLLER AND ROTATING ELEMENT ASSEMBLY, DRYER, COOLING ROLLER STAND AND PRINTING PRESS HAVING THE APPLICATOR ROLLER AND METHOD FOR COATING A MATERIAL WEB

CROSS-REFERENCE TO RELATED APPLICATION

This application claims the benefit under 35 U.S.C. §119 (e) of copending provisional application No. 60/370,194, filed Apr. 5, 2002.

BACKGROUND OF THE INVENTION

FIELD OF THE INVENTION

The invention relates to an applicator roller having a roller jacket formed with a jacket surface for receiving a liquid thereon and for at least partly transferring the liquid. The invention also relates to an applicator roller and rotating element assembly, as well as to a dryer, a cooling roller stand and a printing press having the applicator roller.

Furthermore, the invention relates to a method of coating material webs with a liquid, in particular silicone oil emulsion, which is applied to the material web via an outer circumferential surface of a roller jacket of an applicator roller.

In web-fed rotary printing, for example in web-fed rotary offset printing, a material web is unwound from a supply reel in a reel changer, guided vertically or horizontally through a plurality of successively disposed printing units in order to print it, then guided through a dryer, for example, a hot air dryer, in order to dry it. The material web is finally guided over cooling rollers of a cooling roller stand in order to cool down the material web heated in the dryer. Thereafter, the material web can be cut and folded into signatures in a folder, and the signatures thus produced can be fed to a distribution system, as well. The material web is normally printed on both sides thereof and in many colors by the printing units. The use of dampening solution is necessary in conventional offset printing, due to which the material web has to be dried initially, and consequently cooled down before further processing.

Cooling roller stands of the prior art usually have a plurality of cooling rollers over and between which a cooling medium flows. The material web is guided through the cooling roller stand and around the cooling rollers on a meandering web path.

It is furthermore known to apply a liquid coating medium, for example silicone oil emulsion, to the entire area of the material web by an applicator roller. The applicator roller is able to be disposed within the cooling roller stand. Coating the printed material web with the silicone oil-water emulsion in the form of a thin film prevents the products from being smeared in the region of turner bars or in the folder of the printing press. Furthermore, setting off the printing ink lying under the silicone layer to deflection elements, for example to turner bars, is prevented.

German Published, Non-prosecuted Patent Application DE 197 43 741 A1 discloses an installation for coating substrate webs with a coating medium, which includes applicator rollers for respectively picking up and scooping up the coating medium, in particular silicone oil emulsion, from a respective dip trough or bath. The jacket or circumferential surfaces of the applicator rollers which are wetted with the coating medium are disposed in contact with the substrate web.

The composition of the surface of the respective applicator roller is not described in further detail in that German application, so that it must be assumed that that roller surface is a usually smooth and closed surface.

Furthermore, U.S. Pat. No. 3,923,936 describes a roller having regularly distributed and comparatively small openings formed in the surface thereof. The described roller can serve either for transferring a liquid to a surface or for picking up a liquid from a surface. The roller can, moreover, be constructed as a dip roller together with a dip trough or bath or as a hollow roller having an interior which is acted upon by a liquid or by a vacuum or negative pressure. Furthermore, the roller can serve for dehydrating or dewatering paper, for example a paper web being guided through a gap between the described roller and a further counterpressure or back-pressure roller. In that regard, the liquid absorbed by the described roller due to capillary action of the openings is forced out of the sponge-type surface of the described roller in a further gap to a further counterpressure roller.

The absorbent surface, therefore, picks up liquid in order either to transfer it to the web or remove it from the web. A strict distinction is drawn between those two possibilities in the aforementioned U.S. Pat. No. 3,923,936.

Furthermore, German Published, Non-prosecuted Patent Application DE 29 34 005 A1 describes a device for removing liquid from moving strip material, wherein a hollow roller rolls on the surface of the strip material, for example cold-rolled, high-speed metal strips, and the surface of the hollow roller is covered with at least one layer of absorbent material. Furthermore, the hollow roller has a perforated circumferential jacket under the absorbent material. The perforations or holes formed in the jacket are provided for the passage of liquid, which is taken up by the at least one layer of absorbent material, into the interior of the hollow roller, which is under vacuum or negative pressure.

However, the hollow roller with the absorbent surface described in the last-mentioned reference is not used for applying a liquid to the strip material.

German Patent DE 199 57 453 C1 discloses a method for applying highly viscous ink in an offset printing press. A hollow roller is employed having a surface formed by a netlike structure, through which the printing ink guided into the interior of the hollow roller can travel to the outside and, therefore, transfer to a further roller. Excess and non-transferred ink is entrained or carried around for a complete revolution of the roller and is forced back into the netlike structure by the contact pressure between the netlike roller and the following further roller in the contact gap between the netlike roller and the further roller.

However, the roller disclosed in the last-mentioned reference does not have a surface for applying the ink. Instead, the surface is reduced as much as possible so that, due to the netlike structure, a large number of openings are made available through which the ink application or transfer takes place.

U.S. Pat. No. 4,188,882 discloses a dampening device for offset printing presses. In that device, a dampening solution is picked up by a dip roller in a dip trough and transferred to a netlike surface of a further roller, which is acted upon from the inside with blast air in such a manner that the transferred dampening solution is sprayed from the netlike surface in a direction towards an element to be dampened.

A problem arises during the application of a liquid by an applicator roller to, for example, a material web or a further roller disposed downstream. The problem is that excess liquid can accumulate in the form of a reservoir in the inlet wedge or pocket between the applicator roller and either the material web or the further roller.

A further problem arises during coating of a material web. The further problem is that the material web can have reduced contact with the applicator roller during transport, for example as a result of fluttering of the material web, and that in such cases excess liquid from the reservoir formed in the inlet wedge or pocket can escape through the gap between the material web and the applicator roller and thus, in a nonuniform distribution, can form a coating on the material web. Those irregularities in the coating are detectable in the final product, for example a printed product, and consequently reduce the quality thereof in an unacceptable manner.

SUMMARY OF THE INVENTION

It is accordingly an object of the invention to provide an applicator roller having a roller jacket, an applicator roller and rotating element assembly, a dryer, a cooling roller stand and a printing press having the applicator roller and a method for coating a material web, which overcome the herein aforementioned disadvantages of the heretofore-known devices and methods of this general type and with which a uniform application, transfer or coating of a liquid is possible.

It is a further object of the present invention to provide such an applicator roller which prevents an accumulation of excess liquid.

It is also an object of the invention to provide an alternative applicator roller or an alternative transfer roller to those rollers heretofore known from the prior art.

It is yet another object of the invention to provide a method for coating material webs which avoids an accumulation of excess liquid.

Moreover, it is an object of the invention to rectify or at least reduce the aforedescribed problems during the application or transfer of a liquid or during coating with a liquid.

With the foregoing and other objects in view, there is provided, in accordance with the invention, an applicator roller comprising a roller jacket having an outer cylindrical surface for picking up a liquid and, at least to some extent, for transferring the liquid. The roller jacket is formed with at least one perforation through which excess liquid is guidable into a hollow interior of the applicator roller.

With the objects of the invention in view, there is also provided a combination of an applicator roller and a rotating element disposed downstream therefrom in a liquid travel direction. The applicator roller comprises a roller jacket having an outer cylindrical surface for picking up the liquid and, at least to some extent, for transferring the liquid. The roller jacket is formed with at least one perforation through which the excess liquid is guidable into a hollow interior of the applicator roller. The rotating element is a roller, a cylinder or a continuously onward moving element such as a material web or a paper web. The liquid is water, dampening solution, silicone oil emulsion or ink. The excess liquid is guidable into the interior of the applicator roller from an accumulation thereof in an inlet wedge formed between the applicator roller and the rotating element.

In accordance with a further feature of the invention, the applicator roller serves for scooping up the liquid from a dip trough by the outer cylindrical surface of the roller jacket or for picking up the liquid from a rotating element disposed upstream therefrom in a travel direction of the liquid.

In accordance with an added feature of the invention, the excess liquid guidable into the interior of the applicator roller is at least to some extent feedable to the dip trough through the at least one perforation.

In accordance with an additional feature of the invention, the applicator roller is formed with a plurality of axial active regions, and the roller jacket is formed with a plurality of perforations in addition to the at least one perforation. Each of the plurality of axial active regions has at least one of the perforations.

In accordance with yet another feature of the invention, the perforations are formed in the roller jacket so as to be offset in circumferential direction and in axial direction. Some of the perforations at least partly overlap common axial regions.

In accordance with yet a further feature of the invention, the perforations are linear perforations.

In accordance with yet an added feature of the invention, the perforations have a length of less than 50 mm and a width of less than 1 mm.

In accordance with yet an additional feature of the invention, the interior of the applicator roller has absorbent material therein.

In accordance with still another feature of the invention, the absorbent material is sponge-type material or a sponge body.

With the objects of the invention in view, there is additionally provided a cooling roller stand integrated into a dryer, comprising an applicator roller. The applicator roller includes a roller jacket having an outer cylindrical surface for picking up a liquid and, at least to some extent, for transferring the liquid. The roller jacket is formed with at least one perforation through which excess liquid is guidable into a hollow interior of the applicator roller.

With the objects of the invention in view, there is further provided a cooling roller stand disposed immediately downstream of a dryer, comprising an applicator roller. The applicator roller includes a roller jacket having an outer cylindrical surface for picking up a liquid and, at least to some extent, for transferring the liquid. The roller jacket is formed with at least one perforation through which excess liquid is guidable into a hollow interior of the applicator roller.

With the objects of the invention in view, there is also provided a printing press, comprising an applicator roller. The applicator roller includes a roller jacket having an outer cylindrical surface for picking up a liquid and, at least to some extent, for transferring the liquid. The roller jacket is formed with at least one perforation through which excess liquid is guidable into a hollow interior of the applicator roller.

In accordance with a further feature of the invention, the printing press is a web-fed rotary printing press or a web-fed rotary offset printing press.

In accordance with an added feature of the invention, the printing press includes a cooling roller stand having integrated therein at least one applicator roller, including a roller jacket having an outer cylindrical surface for picking up a liquid and, at least to some extent, for transferring the liquid. The roller jacket is formed with at least one perforation through which excess liquid is guidable into a hollow interior of the applicator roller.

In accordance with an additional feature of the invention, the printing press includes a dryer having a cooling roller stand integrated therein or a cooling roller stand disposed immediately downstream from the dryer. The cooling roller stand has at least one applicator roller including a roller jacket having an outer cylindrical surface for picking up a liquid and, at least to some extent, for transferring the liquid. The roller jacket is formed with at least one perforation through which excess liquid is guidable into a hollow interior of the applicator roller.

In accordance with yet an additional feature of the invention, the dryer is a hot air dryer.

With the objects of the invention in view, there is additionally provided a method for coating a material web, which comprises applying a liquid to the material web by the outer circumferential surface of a roller jacket of an applicator roller, and guiding excess liquid into the interior of the applicator roller via at least one perforation formed in the roller jacket.

In accordance with another mode, the method of the invention further includes providing the material web as a paper web in web-fed rotary printing or web-fed rotary offset printing.

In accordance with a further mode, the method of the invention further includes providing the liquid as a silicone oil emulsion.

In accordance with a concomitant mode, the method of the invention further includes guiding the excess liquid from a location thereof in an inlet wedge formed between the applicator roller and the material web into the interior of the applicator roller via the one perforation and a plurality of additional perforations formed in the roller jacket.

Thus, an applicator roller according to the invention, having a roller jacket, the outer circumferential surface of which serves for picking up a liquid and transferring it at least to some extent, is distinguished by the fact that the roller jacket is formed with at least one perforation through which excess liquid is led away into the interior of the applicator roller.

Through the use of the applicator roller according to the invention, a uniform application and/or transfer of liquid can advantageously be achieved. The outer circumferential surface of the roller jacket of the applicator roller picks up the liquid and transfers it at least to some extent, but at the same time the applicator roller is prevented from picking up and transferring too much and, therefore, excess liquid.

According to the invention, such excess liquid is led away into the interior of the applicator roller through at least one perforation, i.e., through one or more openings formed in the roller jacket.

The applicator roller according to the invention thus has a circumferential surface which, according to the invention, carries out two functions, namely picking up and transferring the liquid, and guiding excess liquid away into the interior of the applicator roller. In this way, it is advantageously possible to achieve a uniform application/transfer or a uniform coating with a single applicator roller that is configured relatively simply in terms of construction.

Furthermore, irregularities on the element to be coated, for example a material web, produced by excess liquid or by excess coating medium can advantageously be avoided and, as a result, the quality of the element can be increased considerably.

In a further refinement of the invention, the perforation of the outer circumferential surface of the roller jacket of the applicator roller can guide away into the interior of the applicator roller excess liquid, in particular water, dampening solution, silicone oil-water emulsion or ink, which is located in an inlet wedge or pocket formed between the applicator roller and a rotating element disposed downstream, in particular a roller or a cylinder, or an element moving continuously onward, in particular a material or paper web.

In this way, an accumulation of liquid in the inlet wedge or pocket can advantageously be prevented, or liquid already accumulated in the inlet pocket can be dissipated again. The interior of the applicator roller can additionally be formed as a hollow space, and therefore the applicator roller as a hollow roller, so that the liquid passing into the interior through the at least one perforation can be guided away unimpededly.

It is further possible for the applicator roller to receive the liquid scooped up from a dip trough or supply trough by the outer circumferential surface of the roller jacket or picked up or transferred from a rotating element disposed upstream, in particular a roller.

The interaction of the applicator roller with a dip or supply trough, from which the liquid used for the coating is scooped, also serves for the uniform application of the liquid, it being possible in particular for interruptions in the supply of liquid to be avoided, because the applicator roller is always adequately wetted with liquid. However, it is also conceivable for the rotating element disposed upstream to be constructed as a dip roller, and to transfer the liquid to the applicator roller in a transfer gap.

Furthermore, the surface of the applicator roller can also be sprayed with the liquid, or supplying the liquid can be carried out by a chambered doctor blade which is operatively connected to the roller.

Furthermore, provision can be made for the liquid led away into the interior of the applicator roller to be supplied to the dip trough again, at least to some extent, through the perforations in the circumferential surface of the roller jacket of the applicator roller. The liquid level in the dip trough and the liquid level in the interior of the applicator roller are at the same height, because the perforations provide for the dip trough and the interior of the applicator roller to form a system of communicating tubes. During rotation of the applicator roller, however, the liquid level in the interior of the roller can fall and, with a sufficiently small opening ratio at the same time (ratio between open area and total area), for example less than 10%, the liquid level can also fall virtually completely.

The coating medium or the liquid led away into the interior of the applicator roller through the perforations can thus likewise advantageously flow through the perforations into the supply trough again and can be used again for wetting the outer circumferential surface of the applicator roller.

The perforations of the applicator roller advantageously make unnecessary any further equipment for leading away the liquid led away into the interior, for example in the axial direction through the bearing journals of the applicator roller, i.e., it is advantageously possible to dispense with such equipment, which leads to a further reduction in costs and work during the operation and maintenance of the applicator roller.

It is also conceivable, however, for the interior of the applicator roller to be subject to vacuum, for example a slight vacuum, applied thereto in order to pick up the liquid through the perforations, for example from the reservoir in the inlet wedge or pocket. In this regard, for example a pump can be used, with which the suction power through the perforations of the roller jacket can be adjusted.

In order to prevent liquid from being sucked up, which is located in the lower region, and therefore at the same level as the liquid level in the dip trough, the interior of the applicator roller can also be divided into, for example, two chambers, vacuum being applied only to the upper chamber. In this regard, the upper chamber can in particular apply vacuum to that section of the applicator roller which forms the inlet wedge or pocket. This advantageously makes it possible to increase the action of guiding excess liquid away through the perforations.

In a further embodiment of the applicator roller according to the invention, the perforations can be formed in such a way that each axial active region of the applicator roller has at least one perforation or opening.

In this regard, the axial active region of the applicator roller is understood to be every axial section of the applicator roller which is formed for applying or transferring liquid. For example, the end sections of the applicator roller need not belong to the active region of the applicator roller. Providing at least one perforation opening in every axial active region of the applicator roller, i.e., at least one perforation or opening in the outer circumferential surface at any desired point in the circumferential direction within the active region, advantageously ensures that both the application and transfer of the liquid and the action of picking up excess liquid by the applicator roller takes place uniformly, as viewed in the axial direction. Thereby, in particular, visible irregularities, for example the formation of stripes, on a printed product can be avoided.

Furthermore, the action of picking up excess liquid, for example from an inlet wedge or pocket, as viewed in the axial direction, is carried out with high uniformity, so that for example when highly viscous liquids are used, accumulated liquid is dissipated uniformly as viewed in the axial direction.

Furthermore, the perforations can be formed in such a way or can be formed as a linear perforation in such a way that perforation openings disposed to be offset in the circumferential direction and in the axial direction partly overlap common axial regions.

A perforation formed as a linear perforation in the roller jacket of the applicator roller, individual lines or slits of the perforation partly overlapping joint axial regions, is additionally used for the uniform application or transfer of liquid and therefore the uniform coating of material to be coated.

For example, it is of particular advantage to configure the applicator roller in such a way that the perforations or openings have a length of less than 50 mm, or 8 mm to 50 mm, and a width of less than 1 mm, or 0.1 mm to 1 mm, for example 0.25 mm. The perforations or openings can be cut into the roller jacket of the applicator roller by a laser device, for example.

An applicator roller according to the invention can also have a drive, in particular a separate drive or motor.

In a further refinement of the invention, the applicator roller can likewise be driven in oscillation, i.e., oscillating in the axial direction.

An applicator roller according to the invention can preferably be disposed upstream of the first and/or upstream of the second cooling roller of a cooling roller stand. For example, an applicator roller according to the invention can apply silicone oil-water emulsion to a paper web in a section of the web path running vertically from top to bottom between the first and the second cooling roller of a cooling roller stand. In this regard, the applicator roller can be disposed on that side of the material or paper web whereon the second cooling roller is also located, so that the emulsion is applied to the surface of the web before the latter is guided over the following cooling roller, and smearing, set-off or condensation of printing ink on the cooling roller is avoided.

In a further embodiment of the invention, provision can be made for constructing the interior of the applicator roller in such a way that the interior has an increased absorbency, for example a sponge-type material or a sponge body can be disposed in the interior of the applicator roller. In this way, liquid is advantageously sucked inwardly from the perforations or openings, so that an undesirably high application of liquid or nonuniform application does not occur. The use of absorbent material is advantageous in particular in conjunction with circular perforations or openings.

Provision can further be made for a cooling roller stand, in particular a cooling roller stand integrated into a dryer or disposed immediately downstream of a dryer, to be distinguished by an inventive applicator roller as described hereinabove.

Furthermore, a printing press, in particular a web-fed rotary printing press or web-fed rotary offset printing press, can be distinguished by an applicator roller as described hereinabove or by a cooling roller stand having such an applicator roller or by a dryer having such an applicator roller.

A method according to the invention for coating material webs, in particular paper webs in web-fed rotary printing or web-fed rotary offset printing, a liquid, in particular silicone oil emulsion, being applied to the material web by the outer circumferential surface of the roller jacket of an applicator roller, is distinguished by the fact that excess liquid, in particular such liquid as is located in an inlet wedge or pocket formed between the applicator roller and the material web, is guided away into the interior of the applicator roller by at least one perforation formed in the roller jacket.

The advantages indicated above in conjunction with the applicator roller according to the invention as described also result when implementing the method according to the invention of coating material webs, in particular uniform coating of the material web can advantageously be brought about, and the accumulation or build-up of excess liquid can be reduced or even avoided.

The excess liquid is guided away through the perforations for example by the capillary action of the perforations or openings, by the force of gravity acting upon the liquid, by the pressure of the liquid resulting from the height of the reservoir built up, by the contact pressure in the gap between applicator roller and a following roller or material web or by the suction action of a pump or vacuum source operatively connected to the interior of the applicator roller.

Other features which are considered as characteristic for the invention are set forth in the appended claims.

Although the invention is illustrated and described herein as embodied in an applicator roller having a roller jacket, an applicator roller and rotating element assembly, a dryer, a cooling roller stand and a printing press having the applicator roller and a method for coating a material web, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
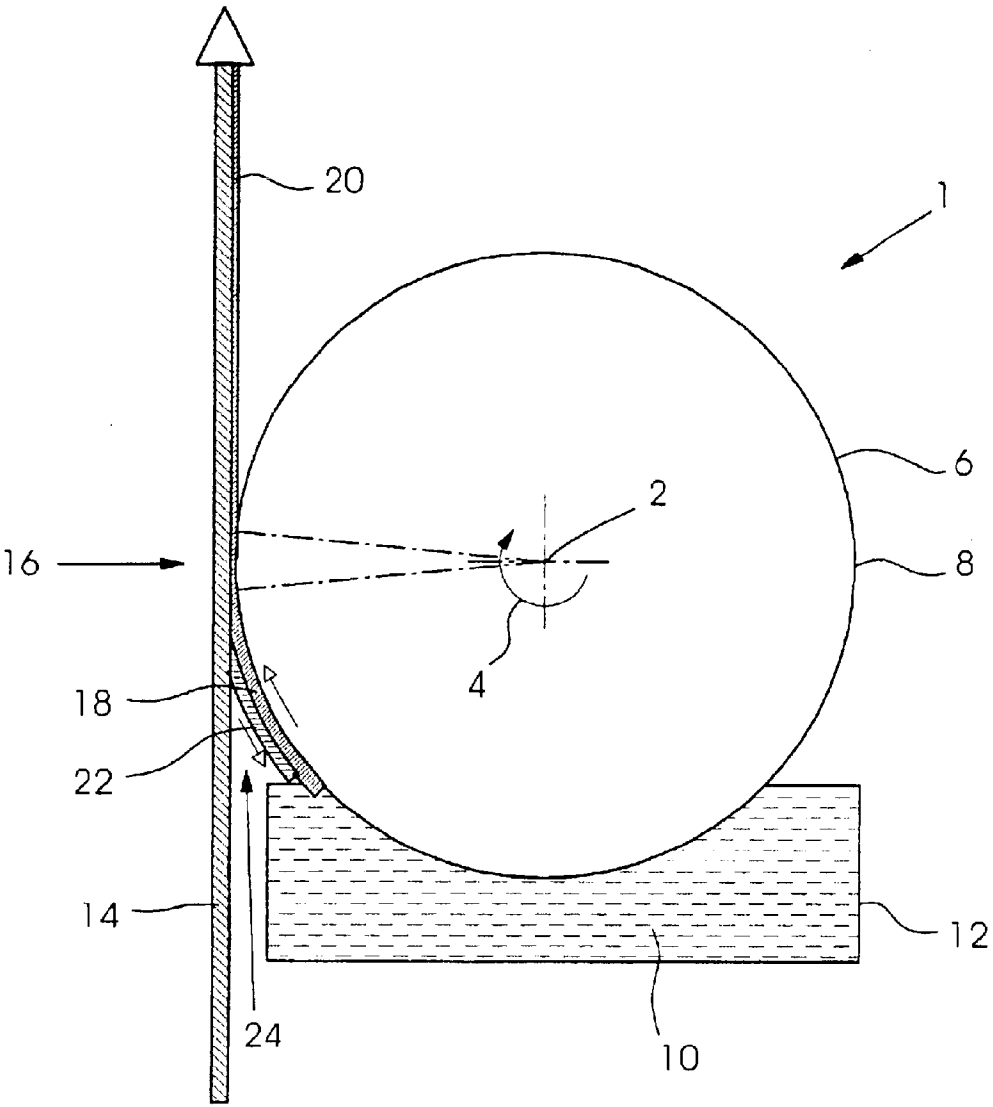
Fig.1 Prior Art
FIG. 1 is a diagrammatic, side-elevational view of an applicator roller according to the prior art, with a material web being guided vertically upwardly from below, the applicator roller being operated so as to run in the same direction as that of the material web.

Referring now to the figures of the drawings in detail and first, particularly, to FIGS. 1 to 7 thereof, there are seen applicator rollers according to the prior art, which have different configurations, namely material and paper web travel or running directions which are different, and rotation directions of the applicator rollers which are different. The various illustrated configurations lead to different relationships with respect to the transport path of the liquid to be applied, which are described in greater detail hereinbelow.

FIGS. 1 to 10 each illustrate at least one respective applicator roller 1 having a rotational axis 2, a direction of rotation represented by a curved arrow 4, a roller jacket 6 and an outer cylindrical or jacket surface 8. Due to the rotation of the applicator roller 1, a liquid 10, for example a silicone oil-water emulsion, is scooped up from a dip trough 12 by the jacket surface 8. The outer cylindrical jacket surface 8 of the applicator roller 1, which is wetted with the liquid 10, rolls on the surface of a transported material web 14 and, in this regard, transfers the liquid 10, which is scooped up from the dip trough 12, to the surface of the material web 14 in the form of a closed liquid film.

FIG. 1 illustrates an example wherein the material web 14 is guided vertically from the bottom to the top of the drawing, and the applicator roller 1 is operated so as to run or rotate in the same direction.

In this regard, the term "run in the same direction" is intended to indicate that the material web 14 and the applicator roller 1 have surface speeds directed in the same direction in the contact region 16 between one side of the surface of the material web 14 and the outer cylindrical or jacket surface 8 of the applicator roller 1. The magnitude of the surface speeds of the material web 14 and the applicator roller 1 may be different, however, in this regard. In contrast therewith, the term "run in the opposite direction" is intended to indicate that the directions of the surface speeds of the material web 14 and of the outer cylindrical or jacket surface 8 are opposed to one another in the contact region 16, it being possible here for the magnitudes of the surface speeds to be of different values, too.

As is ascertainable from FIG. 1, a liquid film 18 forms on the outer cylindrical or jacket surface 8 of the roller jacket 6 and, starting from the surface of the liquid 10 stored in the dip trough, extends as far as the contact region 16 between the jacket surface 8 and the material web 14. This liquid film 18 is entrained or carried along together with the cylindrical jacket surface 8 in accordance with the rotation of the applicator roller 1 and has the effect of coating the material web 14 with a liquid film 20. Excess liquid which does not pass the contact region 16 and thus does not contribute to producing the liquid film 20 runs back into the dip trough 12 in the form of a liquid film 22 on the liquid film 18 transported along by the applicator roller 1. Thus, in this configuration of material web guide direction and applicator roller rotation, there is no problem with excess liquid accumulating on the applicator roller or in the inlet wedge or pocket 24 formed between the applicator roller 1 and the material web 14.

Figure 2:
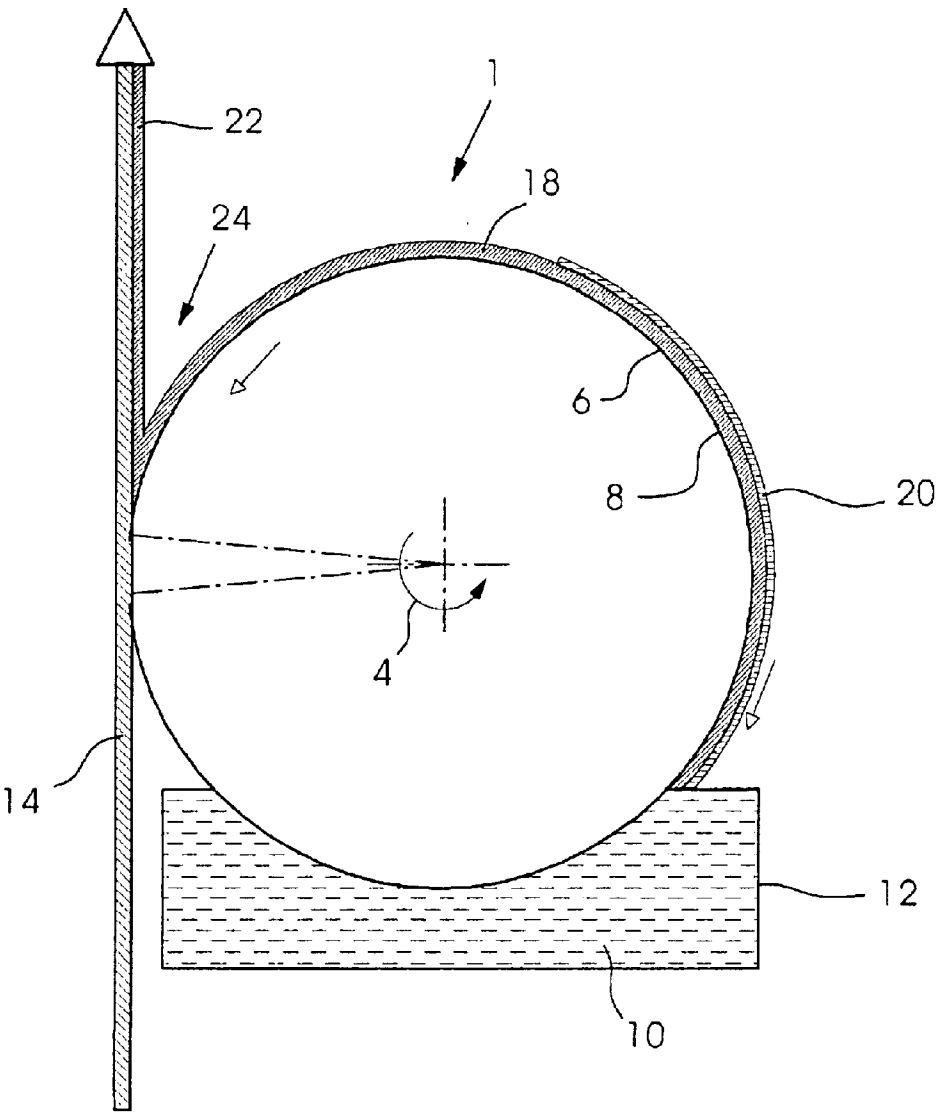
Fig.2 Prior Art
FIG. 2 is a side-elevational view of an applicator roller according to the prior art, with a material web being guided vertically upwardly from below, the applicator roller being operated so as to run in a direction opposite to that of the material web.

In comparison with FIG. 1, FIG. 2 shows the relationships when the rotational direction 4 of the applicator roller 1 is reversed. In this case, a liquid film 18 is likewise formed on the surface 8 of the roller jacket 6 of the applicator roller 1 and is transferred as a liquid film 22 to the material web 14 in the inlet wedge or pocket 24. Because, in this case, the applicator roller 1 is operated so as to run in a direction opposite to that of the material web 14, the latter picks up completely the liquid transported into the inlet wedge or pocket 24 in the form of the liquid film 22, so that there is no accumulation of excess liquid in the inlet wedge or pocket 24. Furthermore, an excessive quantity of scooped-up liquid 10 is returned to the dip trough 12 in the form of a liquid film 20 which runs on the liquid film 18 under the influence of the force of gravity.

Figure 3:
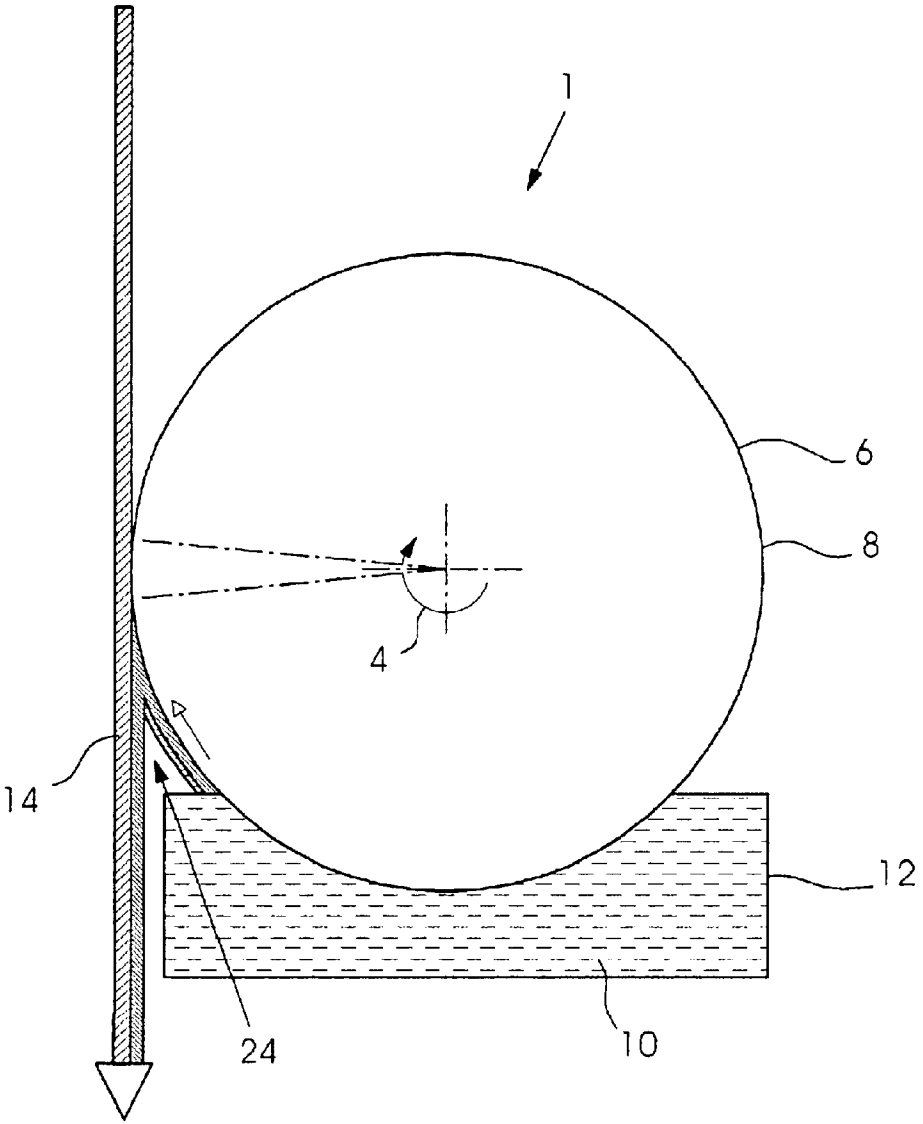
Fig.3 Prior Art
FIG. 3 is a side-elevational view of an applicator roller according to the prior art, with a material web being guided vertically downwardly from above, the applicator roller being operated so as to run in a direction opposite to that of the material web.

FIG. 3 shows the relationships in contrast with FIG. 1 for the case wherein the rotational direction 4 of the applicator roller 1 is maintained, whereas the running or travel direction of the paper web 14, however, is reversed. In this case, too, there is no build-up and accumulation, respectively, of excess liquid in the inlet wedge or pocket 24 formed between the applicator roller 1 and the material web 14.

Figure 4:
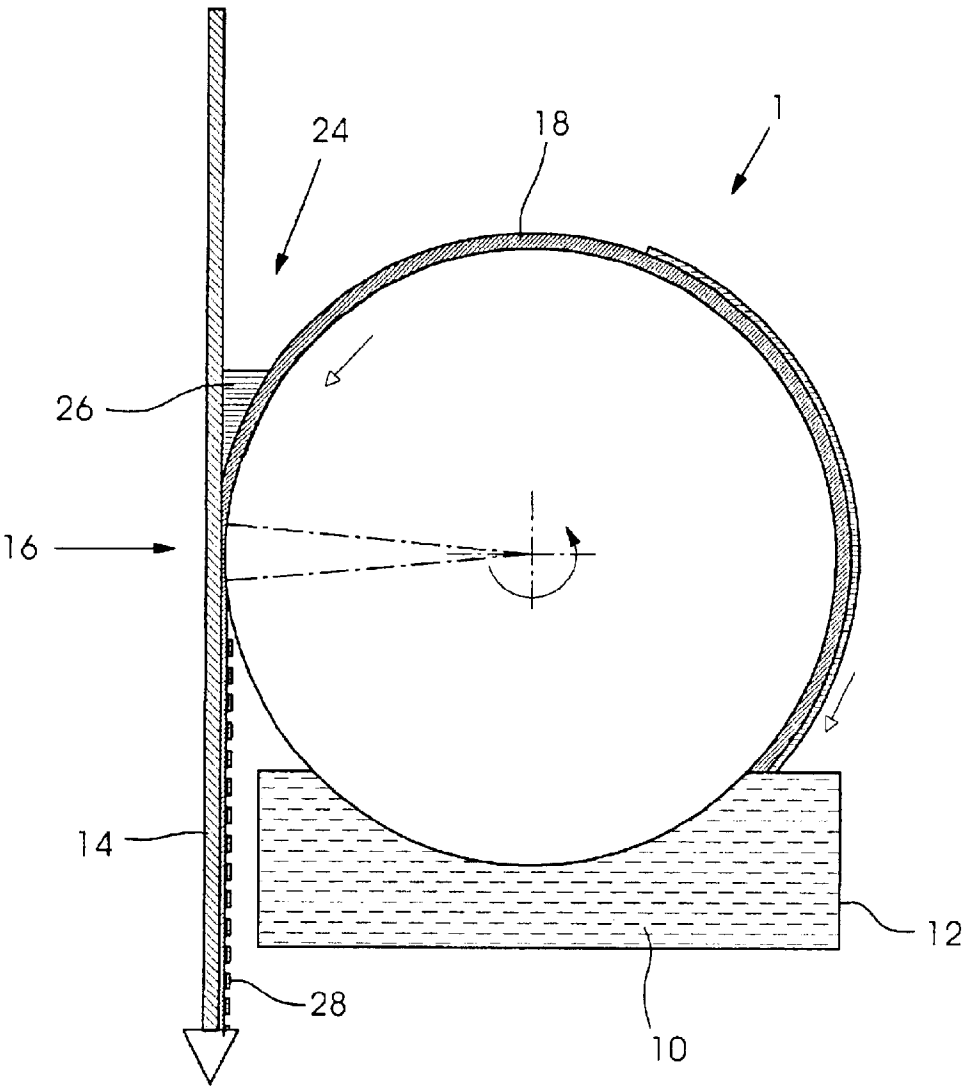
Fig.4 Prior Art
FIG. 4 is a side-elevational view of an applicator roller according to the prior art, with a material web being guided vertically downwardly from above, the applicator roller being operated so as to run in the same direction as that of the material web.

FIG. 4 shows an applicator roller 1 operated so as to run in the same direction as that of the material web 14, however, in contrast with the example of FIG. 1, the transport direction of the material web 14 of FIG. 4 runs in vertical direction from the top to the bottom of the figure. As can be readily ascertained from FIG. 4, in this case, a reservoir 26 of excess liquid builds up in the inlet wedge or pocket 24, and is supplied by the liquid film 18. Consequent to the transport of the material web 14, fluctuations occur in the contact pressure between the material web 14 and the applicator roller 1 in the contact region 16, so that an at least time-variant additional quantity of liquid 28 is transferred to the material web 14 from the reservoir 26. This coating of the material web 14, which is formed, for example, as stripes, considerably reduces the quality of a produced printed product.

Figure 5:
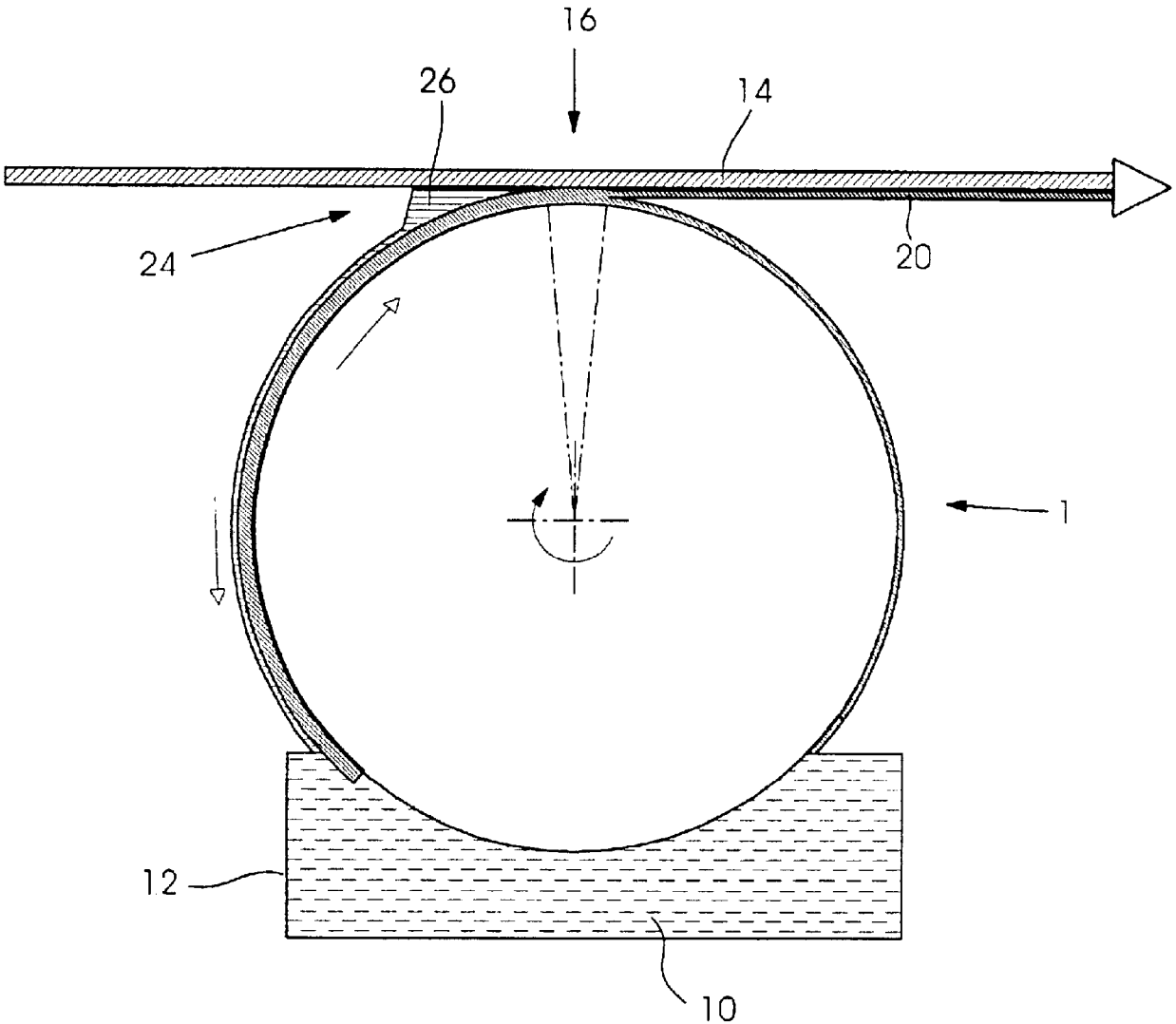
Fig.5 Prior Art
FIG. 5 is a side-elevational view of an applicator roller according to the prior art, with a material web being driven horizontally from the left-hand to the right-hand side of the figure, and the applicator roller being operated so as to run in the same direction as that of the material web.
Figure 7:
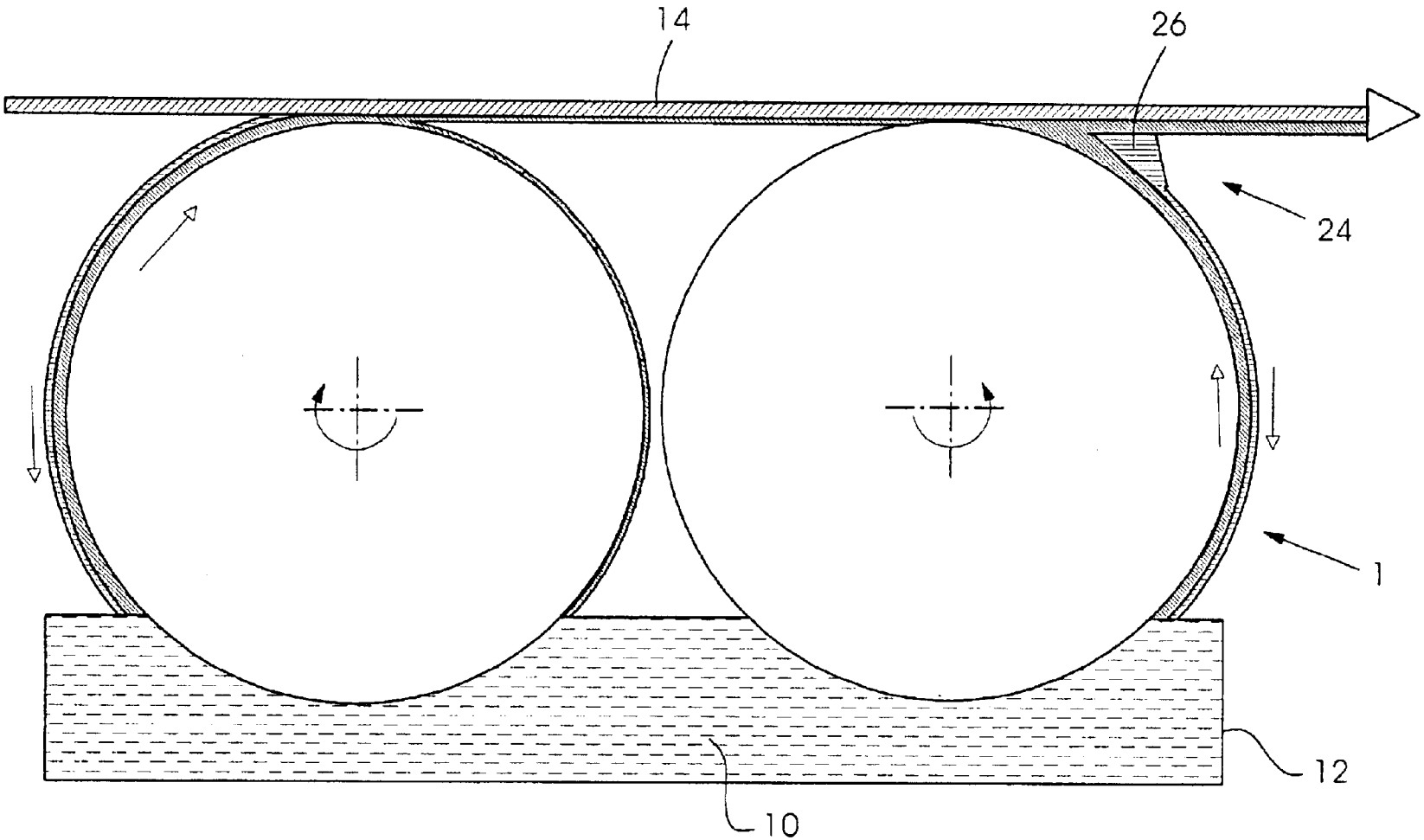
Fig.7 Prior Art
FIG. 7 is a side-elevational view of two applicator rollers according to the prior art disposed after one another, with a paper web being guided horizontally from the left-hand side to the right-hand side of the figure, one of the applicator rollers being operated so as to run in the same direction as that of the paper web, and the other of the applicator rollers being operated so as to run in a direction opposite to that of the paper web.

As shown in FIG. 5 and FIG. 7, the problem of accumulating liquid in the inlet wedge or pocket 24 formed between the applicator roller 1 and the material web 14 can also occur when the material web is guided horizontally.

FIG. 5 shows an applicator roller 1 which is operated so as to run in the same direction as that of the material web 14 and which revolves at such a rotational speed that more liquid is transferred into the inlet wedge or pocket 24 from the dip trough 12 than is conducted away through the contact region 16 in the form of the liquid coating film 20. In this case, the reservoir 26 could be avoided or dissipated by a lower rotational speed of the roller 1, but it may be possible that, at reduced rotational speed, the liquid film 20 on the material web 14 does not have the necessary depth and layer thickness, respectively, or, for example, becomes irregular, so that those skilled in the art would refrain or turn away from reducing the rotational speed.

Figure 6:
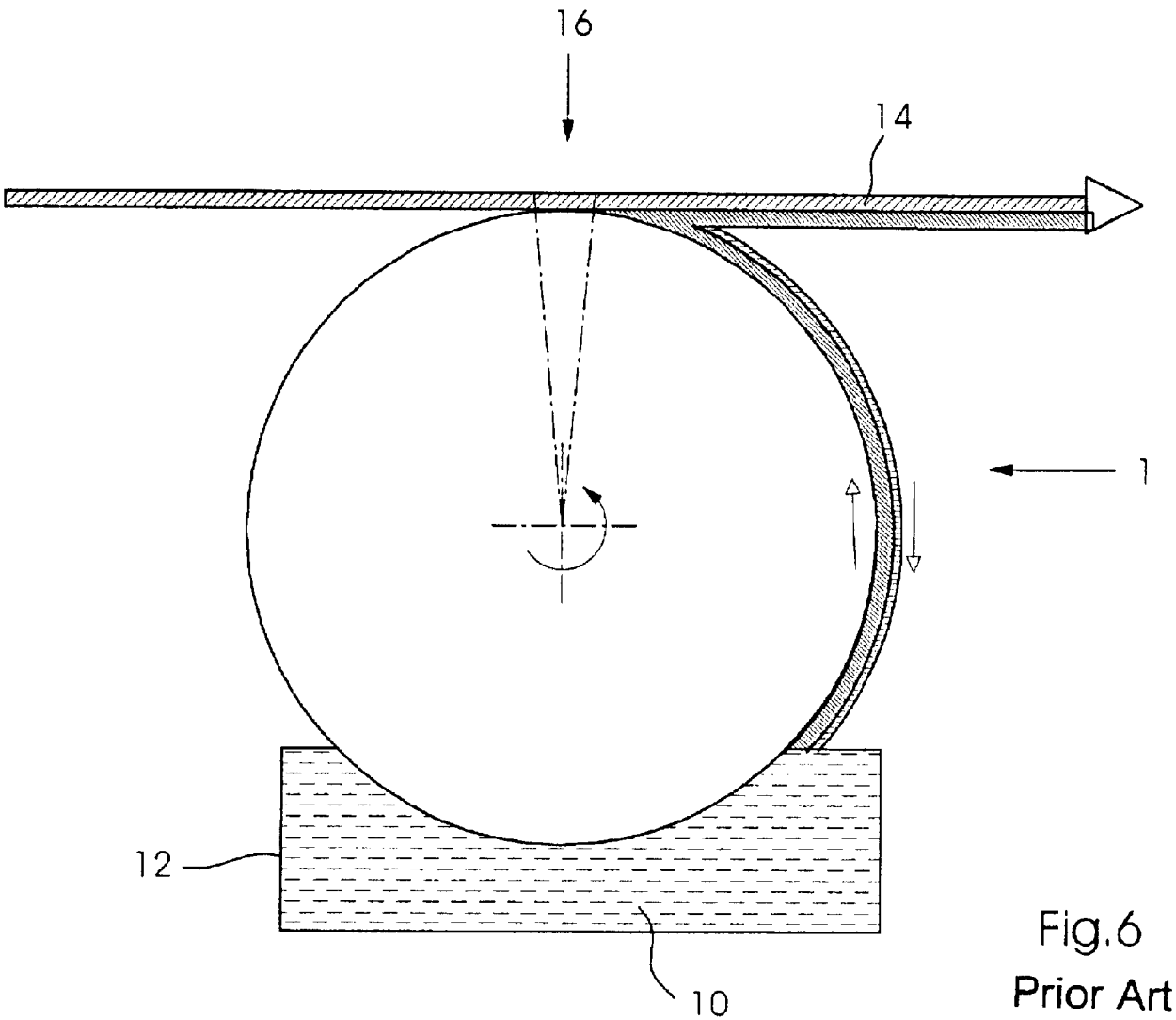
Fig.6 Prior Art
FIG. 6 is a side-elevational view of an applicator roller according to the prior art, with a material web being driven horizontally from the left-hand to the right-hand side of the figure, and the applicator roller being operated so as to run in a direction opposite to that of the material web.

In FIG. 6, the applicator roller 1 of FIG. 5 is shown as operating so as to run in a direction opposite to that of the material web 14, due to which there is no accumulation of liquid in the inlet wedge or pocket 24.

The roller 1 shown at the right-hand side of FIG. 7 is operated so as to run in a direction opposite to that of the material web 14, thus in a manner corresponding to that of the roller 1 shown in FIG. 6, but revolves at a higher rotational speed than the latter roller, so that, in this case, a reservoir 26 is formed in the inlet wedge or pocket 24.

Figure 8:
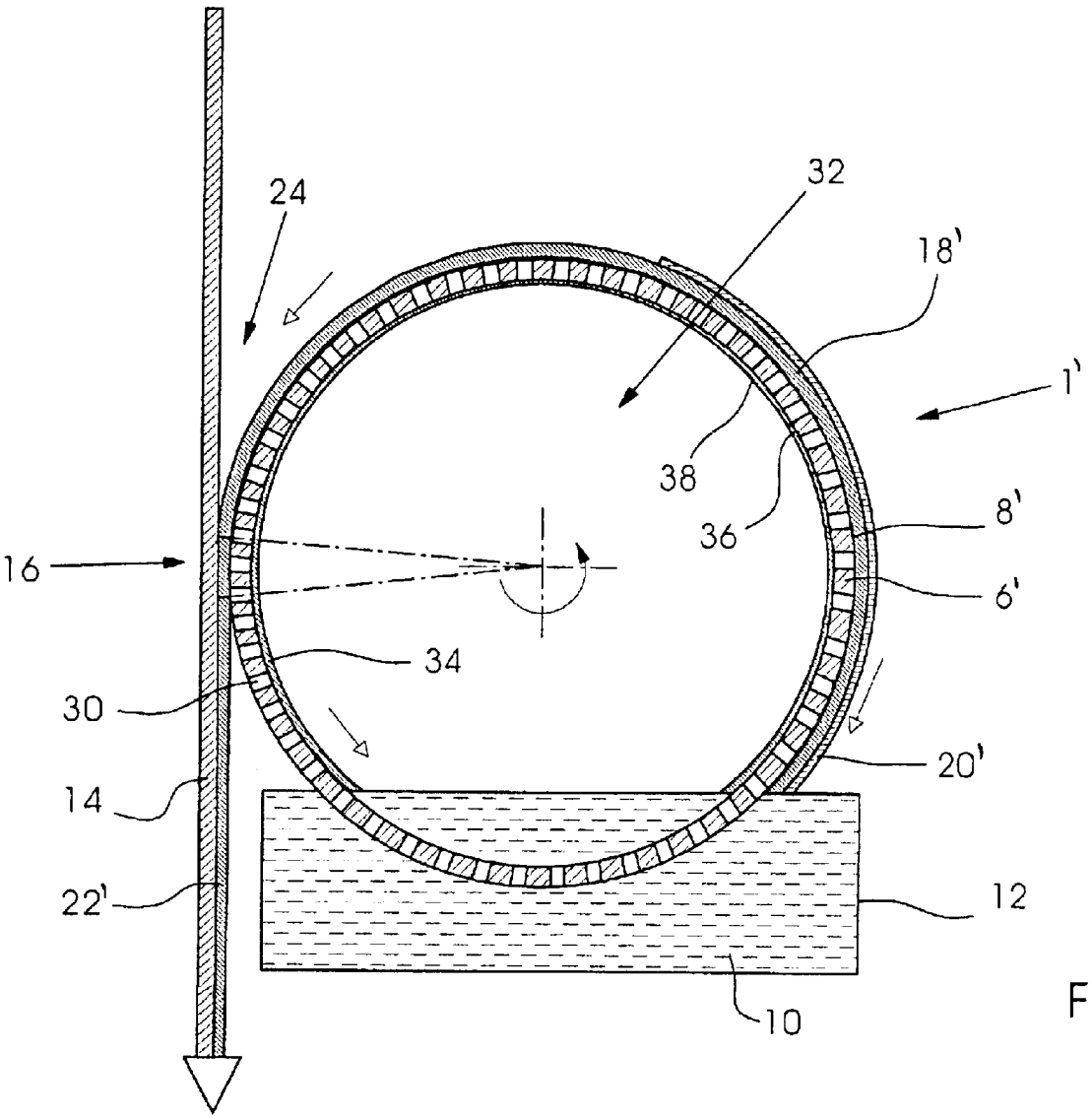
FIG. 8 is a side-elevational view of an applicator roller according to the invention, with a paper web being guided vertically downwardly from above, and the applicator roller being operated so as to run in the same direction as that of the paper web.

FIG. 8 shows an applicator roller 1' according to the invention, having a roller jacket 6' and an outer cylindrical or jacket surface 8' for picking up a liquid film 18' and transferring it at least to some extent in the form of a liquid film 22' to a material web 14 in a contact region 16. According to the invention, the roller jacket 6' is formed with perforations 30 through which excess liquid which, as shown in FIG. 4, could accumulate in the inlet wedge or pocket 24 as a reservoir 26, is guided away into the interior 32 of the applicator roller 1' and there, for example in the form of a liquid film 34, is guided back to the stored liquid 10 in the dip trough 12.

Since the stored liquid 10 in the dip trough 12 outside the applicator roller 1' and within the applicator roller 1' forms a system of communicating tubes, the liquid level is equalized inside and outside the applicator roller 1'. If necessary or desirable, excess liquid may be fed back into the dip trough 12.

Due to the contact pressure prevailing in the contact region 16 between the applicator roller 1' and the material web 14, excess liquid is forced through the perforations 30 into the interior 32 of the applicator roller 1'.

In the embodiment of the applicator roller 1' according to the invention which is shown in FIG. 8, a liquid film 20' also forms on the liquid film 18' that is entrained or carried along with the applicator roller 1' and, as a consequence of the force of gravity, runs back into the dip trough 12.

Prevention of the build-up of a reservoir 26 in the inlet wedge or pocket 24 (note FIG. 4) can be influenced or even controlled, for example, by a suitable selection of the perforations. In other words, the prevention of the build-up is influenced or controlled by the number and configuration and arrangement of the respective perforations or openings formed on the surface of the roller 1', or else by the rotational speed of the applicator roller 1'. In this regard, the rotational speed can also be prescribed by a control unit.

As can further be concluded from FIG. 8, the inner cylindrical or jacket surface 36 of the roller jacket 6' likewise entrains a liquid film 38 from the liquid supply 10. However, this liquid film 38 is guided around with the applicator roller 1', without reaching the outer surface, i.e., without reaching the outer cylindrical or jacket surface 8' of the roller jacket 6', and is guided back to the stored liquid 10 again. At current maximum rotational frequencies of the applicator roller 1' of about 50 to 200 revolutions per minute, it is not possible for the liquid to pass through the perforations 30 from the inside to the outside due to the centrifugal force produced by the rotation of the applicator roller 1'.

It should be mentioned herein that the rotational frequency of the applicator roller is advantageously selected in such a way that the surface speed thereof assumes a prescribed percentage of the material web speed. In other words, in the event of changes in the speed of the material web, for example when starting up a printing press, the rotational frequency of the applicator roller is also changed. This percentage normally lies in the range of from 1% to 10%, for example between 2% and 5% or, for example, below about 3%. An advantageous applicator roller in conjunction with vertical web guidance can have, for example, a maximum rotational frequency of less than 100 revolutions per minute, in particular, 75 revolutions per minute.

Figure 9:
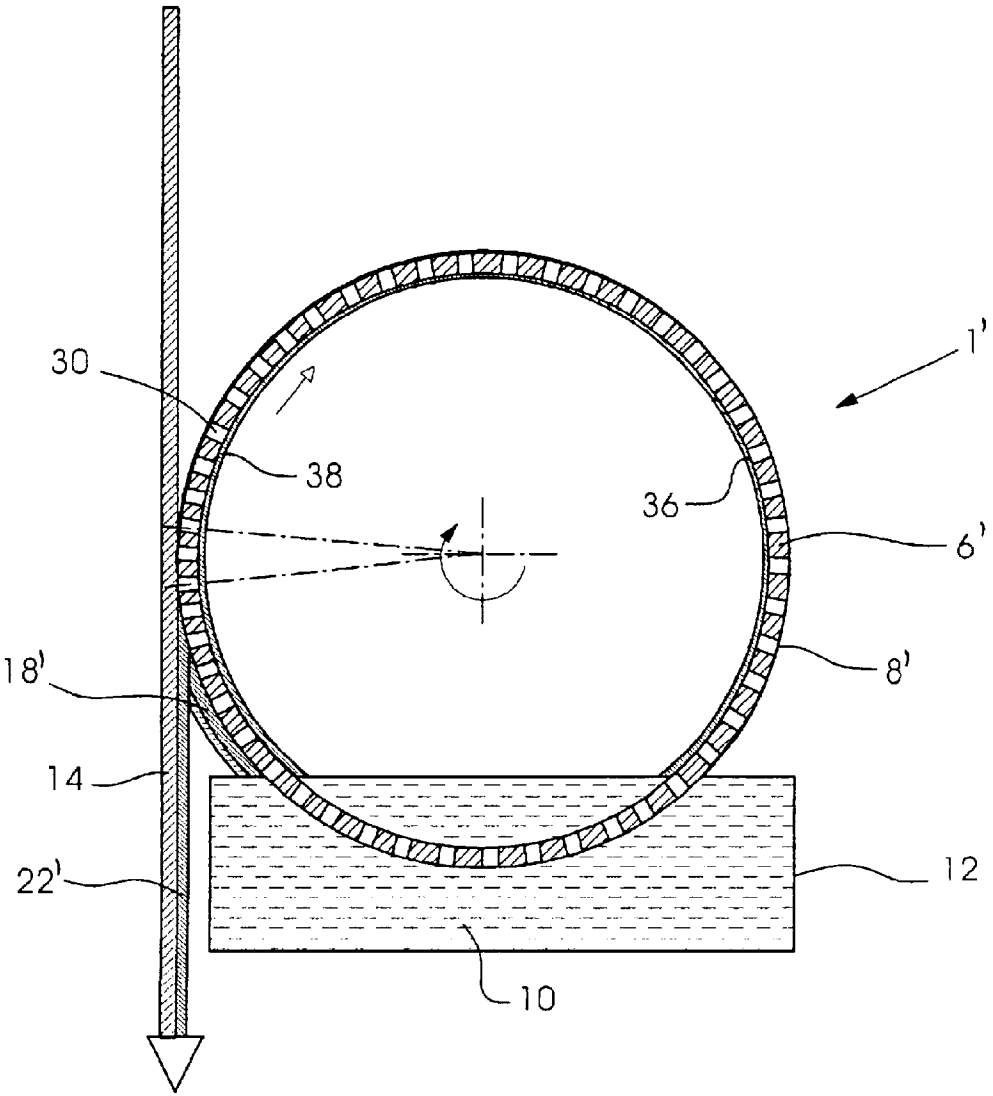
FIG. 9 is a side-elevational view of an applicator roller according to the invention, with a material web being guided vertically downwardly from above, the applicator roller being operated so as to run in a direction opposite to that of the material web.

FIG. 9 shows the applicator roller 1' from FIG. 8, however, now running in a direction opposite to that of the material web 14. In this case, too, the surface 8' of the roller jacket 6' entrains or carries along therewith a liquid film 18' from the supply trough 12, which is of sufficient thickness that a liquid coating film 22' of desired thickness can be formed or built up on the material web 14. It is thus possible without difficulty to operate the applicator roller 1' so that it runs in a direction that is the same direction as or the opposite direction from that of the material web 14, and possibly to alternate between these two operating states.

It should further be noted that the problem of ink build-up on the applicator roller in the situations shown in FIGS. 2, 3 and 6 exists in the situation of FIG. 9, because the web 14 and the surface of the applicator roller 1' are not coated with liquid in the contact region 16. In contrast therewith, this problem is solved by the use of the applicator roller according to the invention in the situation shown in FIG. 9, because the roller surface 8' of the applicator roller 1' is wetted by the capillary action of the perforations or openings 42.

A further disruptive effect of the applicator rollers according to the prior art should be described here. If a conventional applicator roller is operated so as to run in a direction opposite to that of the material web, then more liquid is transferred than during the operation of the applicator roller so as to run in the same direction as that of the material web, because in the latter case the liquid has to pass the contact region.

On the other hand, an applicator roller according to the invention is able to transfer sufficient liquid, for example to a material web, even when the applicator roller is running in the same direction as that of the material web, because, in this operating mode, liquid can be drawn out of the perforations after the contact region has been passed. The operator can therefore advantageously choose the operation wherein the applicator roller is running in the same direction as that of the material web, just as well as the operation wherein the applicator roller is running in the opposite direction from that of the material web, and therefore prevent the build-up of ink on the applicator roller.

Figure 10:
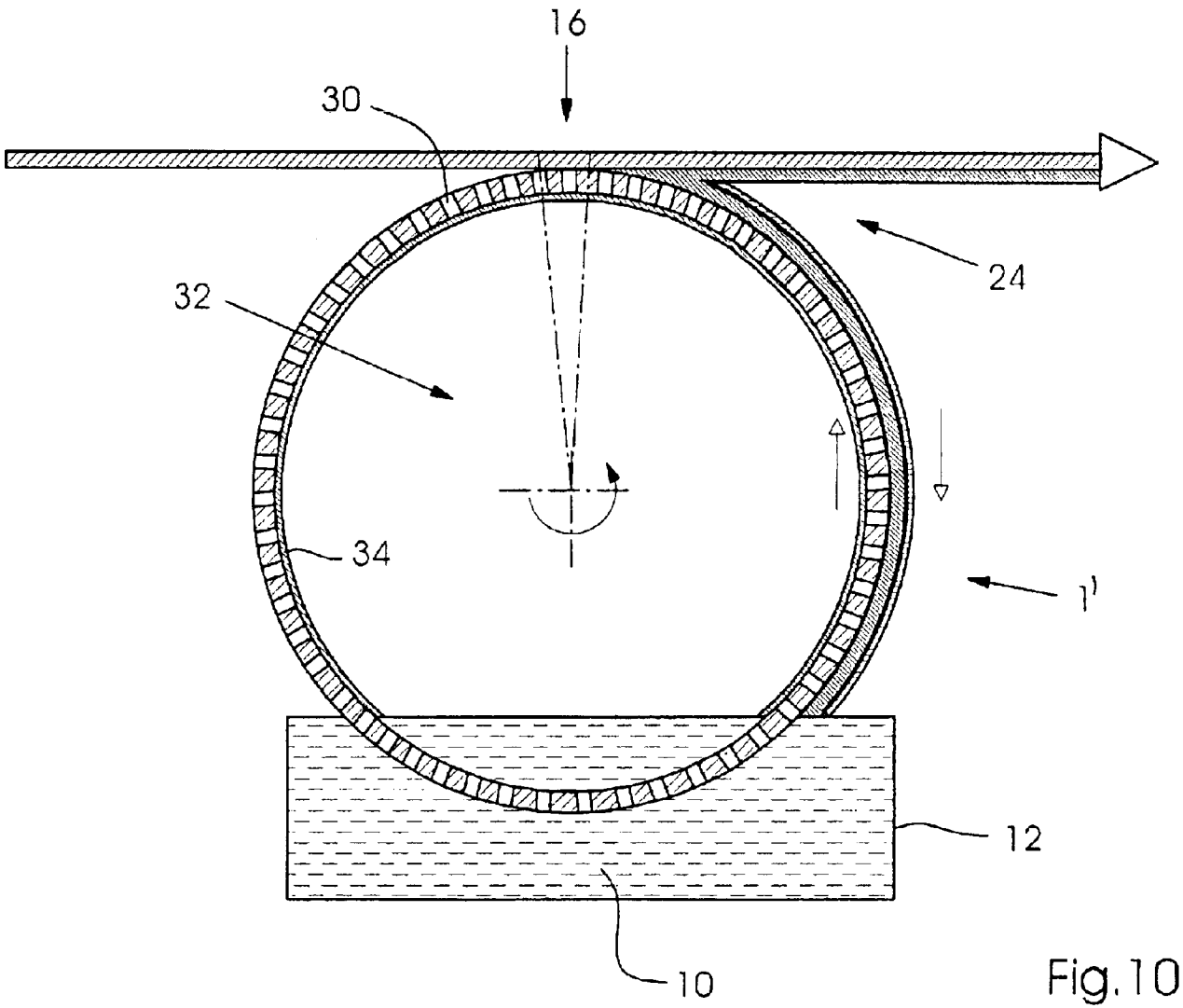
FIG. 10 is a side-elevational view of an applicator roller according to the invention, with a material web being driven horizontally from the left-hand to the right-hand side of the figure, and the applicator roller being operated so as to run in a direction opposite to that of the material web.

Furthermore, FIG. 10 shows how, by using an applicator roller 1' according to the invention, it is possible to prevent a reservoir 26 from building up or forming in the inlet wedge or pocket 24 (note FIG. 7, right-hand roller) in the case of horizontal web guidance. Excess liquid is led away into the interior 32 of the applicator roller 1' through the perforations 30 in the region of the inlet wedge or pocket 24 or of the contact region 16 and, in the interior, is led back in the form of a liquid film to the liquid circuit in the liquid supply 10 contained in the dip trough 12. An advantageous applicator roller in conjunction with horizontal web guidance can, for example, have a diameter between 30 mm and 50 mm, in particular about 38 mm, and a maximum rotational frequency between 150 and 200 revolutions per minute.

In a departure from the illustration of FIG. 10, the applicator roller 1' according to the invention can also advantageously be operated for running in the same direction as that of the material web in the case of horizontal web guidance (note FIG. 7, left-hand roller).

Figure 11:
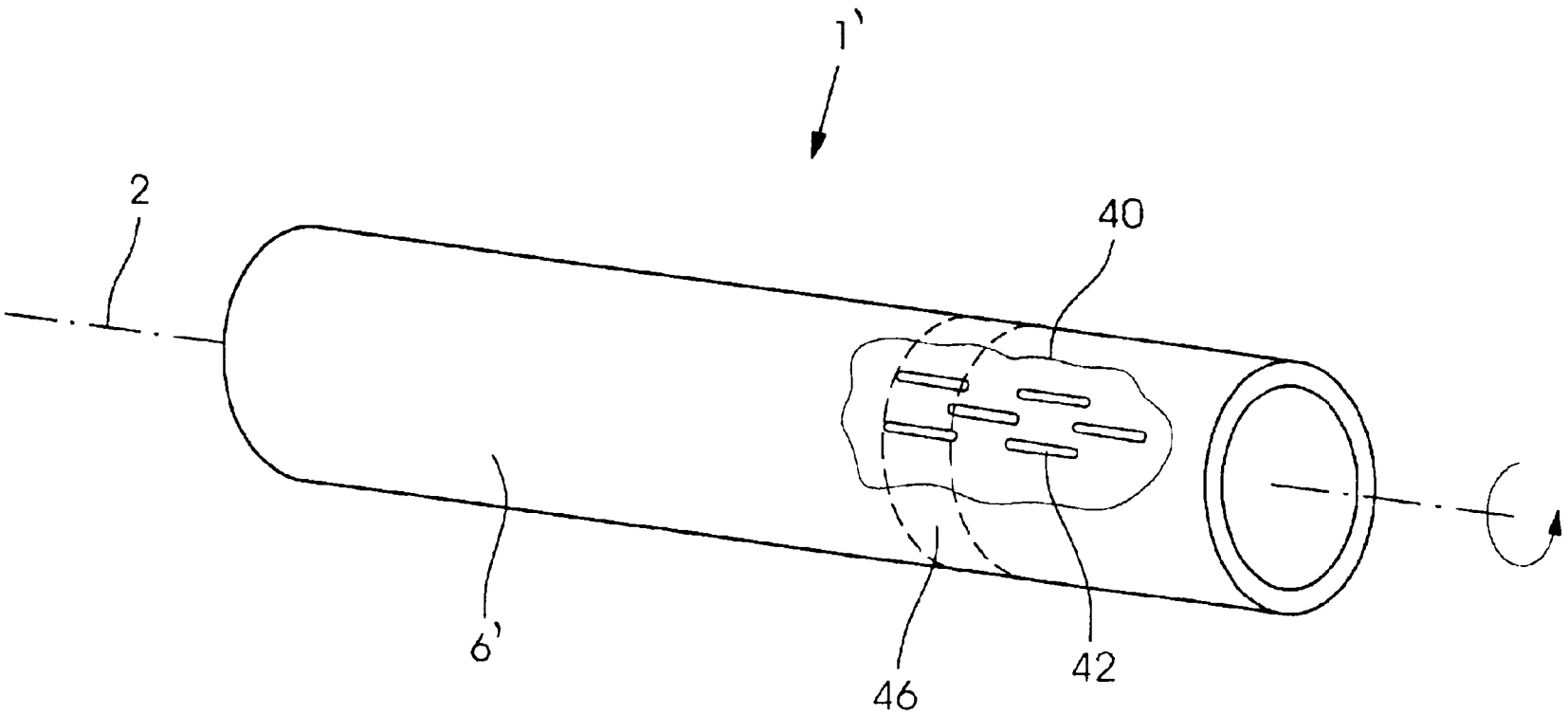
FIG. 11 is a perspective view of a roller jacket of an applicator roller according to the invention, which is formed with perforations.

FIG. 11 shows the roller jacket 6' of an applicator roller 1' according to the invention with a rotational axis 2, the perforations 42 of the roller jacket 6' being illustrated in a region 40. The perforations 42 are formed as linear perforations or slits disposed at least approximately parallel to the axis of rotation, and being offset axially and in circumferential direction.

Also derivable from FIG. 11 is that the axial active region 46 defined by the two broken circumferential lines has at least one perforation or opening, although two are actually shown. Although not illustrated in FIG. 11, an applicator roller according to the invention can be formed with perforations, as shown in region 40, over the entire active surface of the roller jacket and can therefore be formed so that each axial active region 46, i.e., each axial region provided for the transfer of liquid, has at least one perforation or opening 43.

Figure 12:
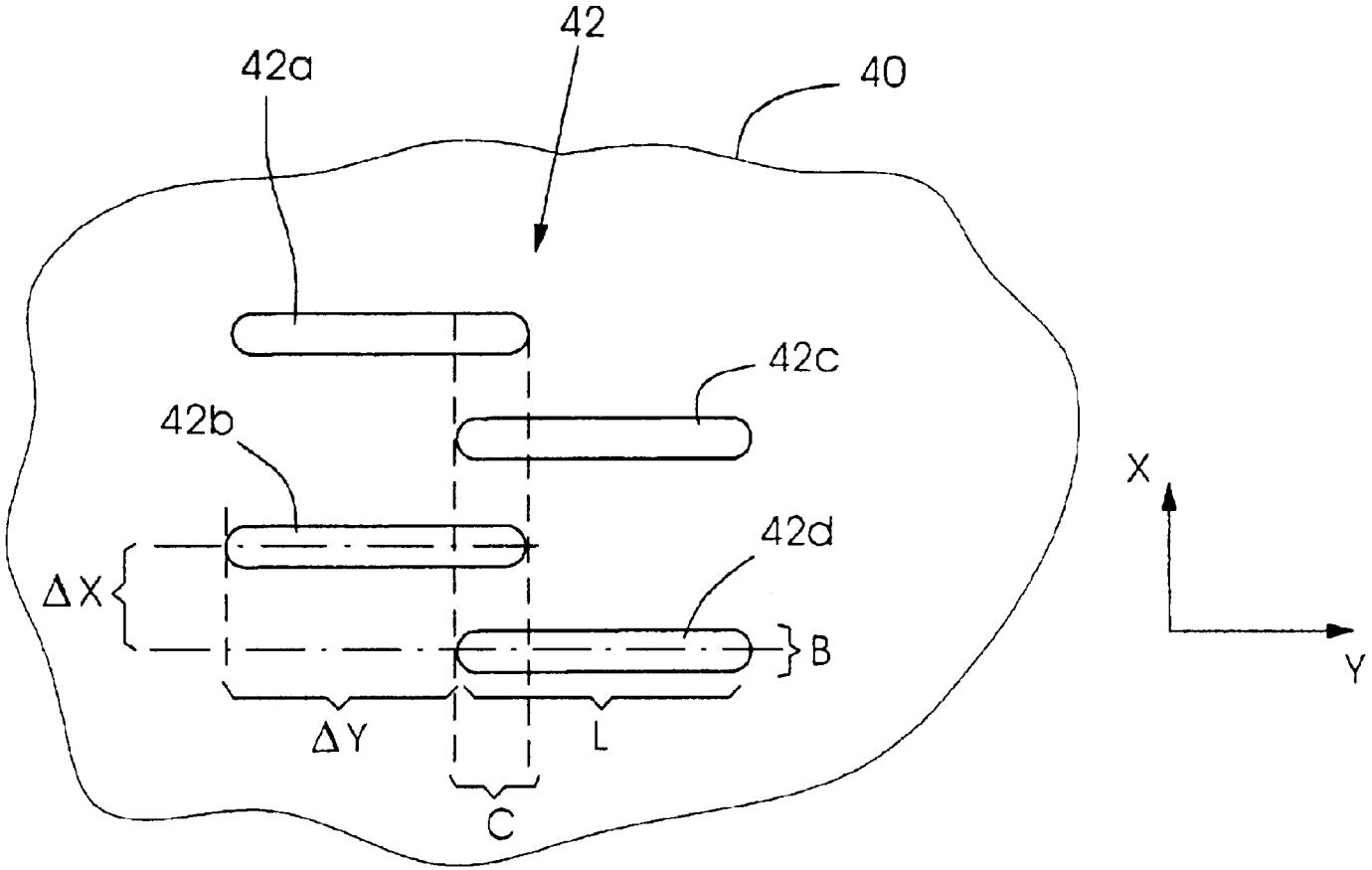
FIG. 12 is an enlarged, fragmentary view of FIG. 11 showing a portion of the circumferential jacket surface of the roller jacket of an applicator roller according to the invention.

FIG. 12 shows the region 40 in an enlarged diagrammatic view, it being possible to see the offset configuration of the perforations or openings 42 both in the axial direction Y and in the circumferential direction X. The individual perforations or openings 42*a* to 42*d*, respectively, have a length L and a width B, the length L extending in the axial direction, and the width B in the circumferential direction. FIG. 12 further reveals that the perforations or openings 42*a* to 42*d* overlap a common axial region C. For the case wherein all the end sections of the perforations or openings 42 overlap in this way, assurance is offered that there are no axial regions of the applicator roller 1', which do not have at least one perforation or opening or at least one part of a perforation or opening, and thereby prevent the formation of the stripes by excess liquid that has not been led away.

As shown in FIG. 12, the two perforations or openings 42*b* and 42*d* have an axial offset of Δ-Y and an offset in the circumferential direction of Δ-X. The surface of the applicator roller 1' between the perforations or openings 42 is sufficiently large, according to the invention, that adequate scooping of liquid and picking up and transferring of this liquid in the desired and necessary amount is assured. For example, provision can advantageously be made for selecting the ratio of the total area of the openings 42 to the total surface of the applicator roller 1' in the range between 1% and 50%. In order to dissipate or prevent the formation of reservoirs 26, a ratio of less than 5%, in particular less than 3% or more particularly about 1% will advantageously be selected. In order to achieve a rewetting of a dried material web with the applicator roller 1', in addition to the application of, for example, silicone oil emulsion, a ratio of more than about 10% will advantageously be selected.

Besides a linear perforation or slit, every other type of perforation is also conceivable, for example an at least approximately circular hole, it being possible for the perforations or openings, for example, advantageously to have a diameter of 1 mm to 10 mm, in particular about 2 mm or about 4 mm.

Figure 13:
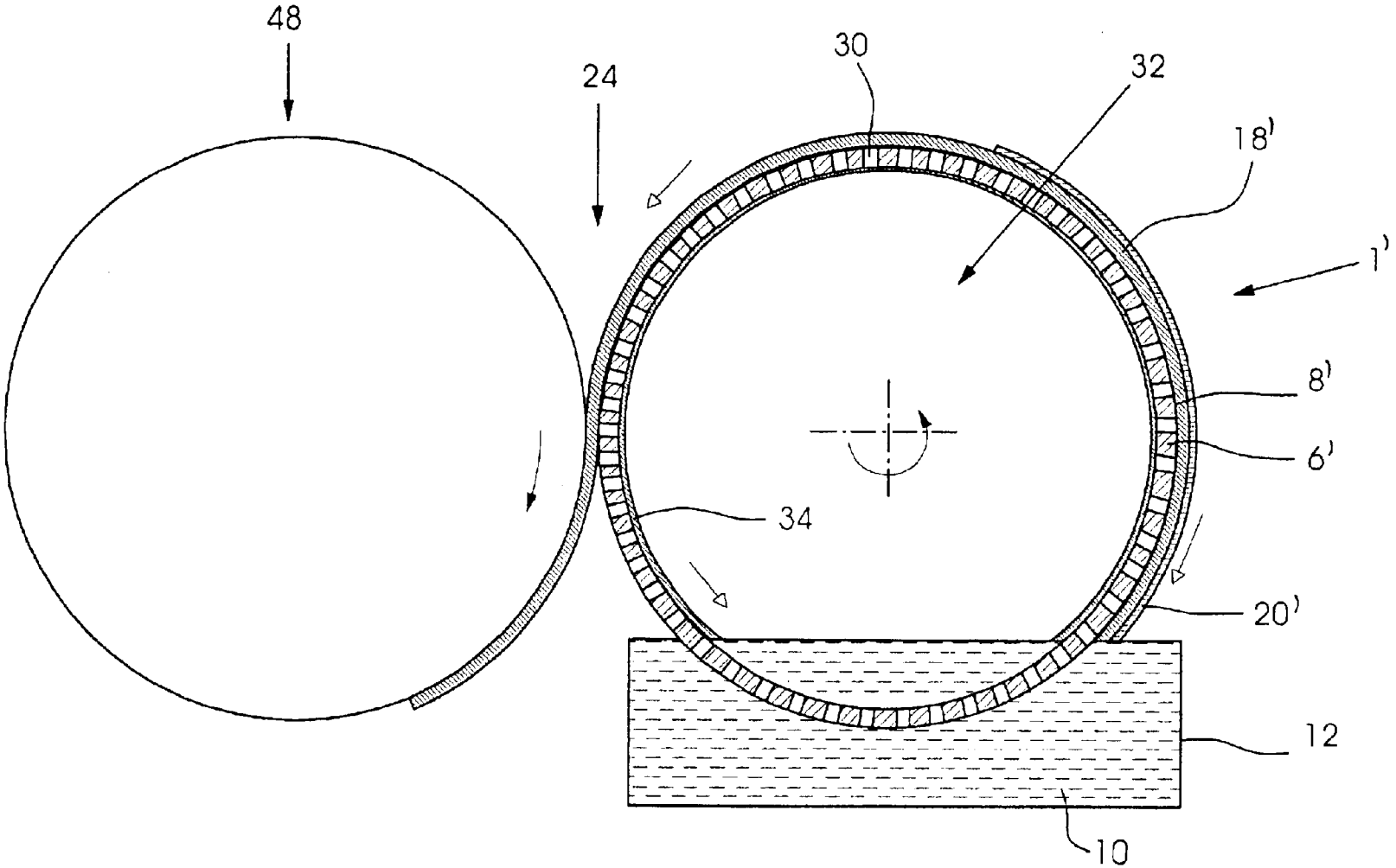
FIG. 13 is a side-elevational view of an assembly of a perforated applicator roller according to the invention in conjunction with a following roller.

Furthermore, FIG. 13 shows that the applicator roller 1' may also transfer the liquid film 18' to a roller 48 disposed downstream and, in this regard, can be used with advantage for preventing the production of a liquid reservoir in the inlet wedge or pocket 24 between the applicator roller 1' and the roller 48 disposed downstream. It is thus possible, for example, also to use the applicator roller 1' according to the invention in an inking-roller or dampening-roller train within an inking or dampening unit of a printing press.

Figure 14:
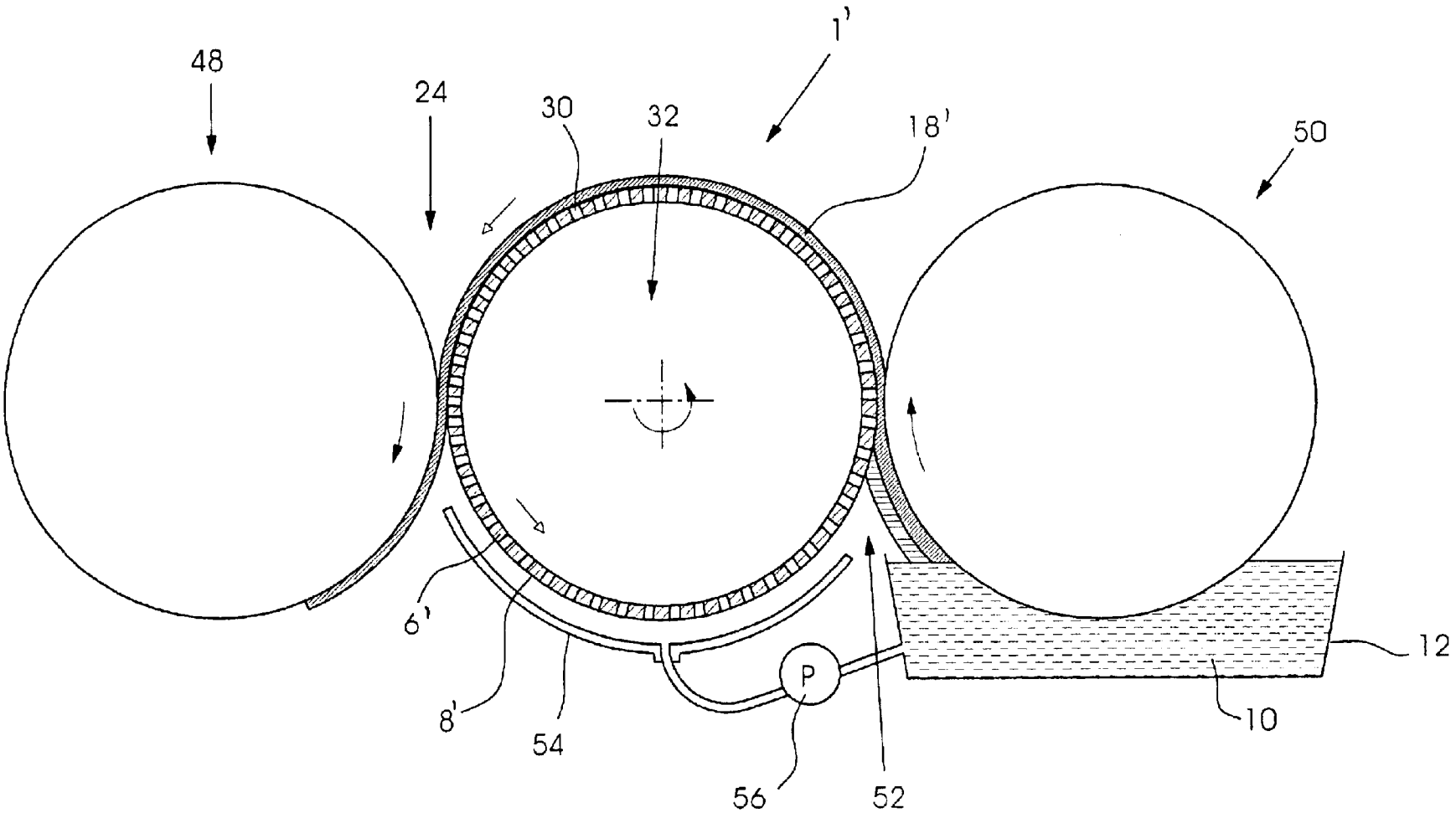
FIG. 14 is a side-elevational view of an assembly of a perforated applicator roller according to the invention in conjunction with a roller disposed upstream therefrom and a roller disposed downstream therefrom.

As FIG. 14 shows, the applicator roller 1' according to the invention may also be used between a roller 50 disposed upstream and a roller 48 disposed downstream for transferring a liquid from the upstream roller 50 to the downstream roller 48. In this regard, the applicator roller 1' according to the invention, which in this case can also be referred to as a transfer roller, prevents the production of a reservoir in the inlet wedge or pocket 24 between the roller 48 disposed downstream and the applicator roller 1', and also the production of a reservoir in the inlet wedge or pocket 52 between the roller 50 disposed upstream and the applicator roller 1'. Excess liquid, for example water, ink, dampening solution or silicone oil emulsion, is led away into the interior 32 of the applicator roller 1' through the perforations 30 formed in the roller jacket 6' of the applicator roller 1'.

Figure 15:
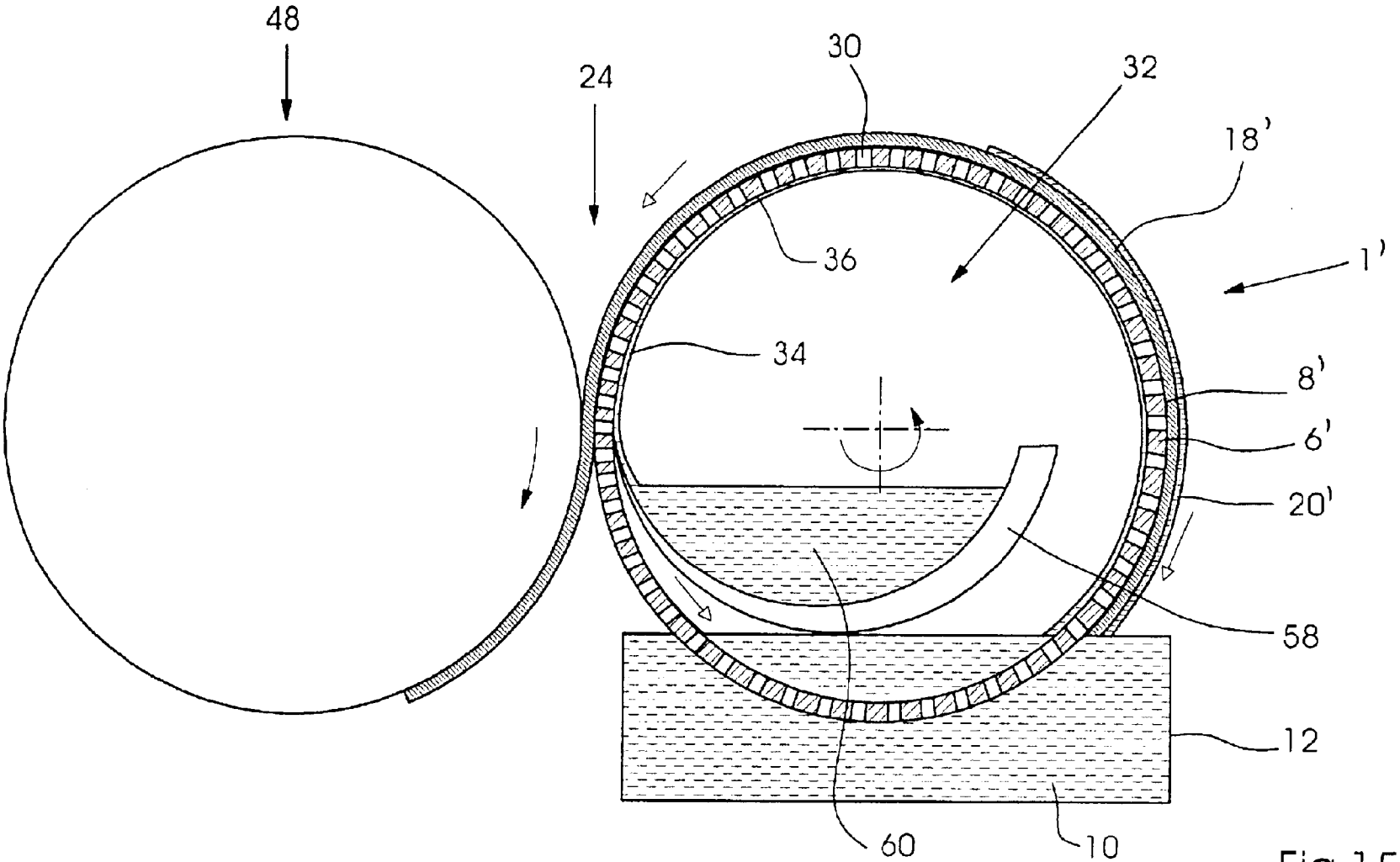
FIG. 15 is a view similar to that of FIG. 13, with a discharge element disposed in the interior of the applicator roller according to the invention.

The excess liquid can then be guided out of the applicator roller 1' in the axial direction (as shown in FIG. 15) or again, as shown in FIG. 14, fed through the perforations, due to the force of gravity, to a collecting region 54, for example in the form of a curved sheet, and fed back therefrom to the liquid supply 10 again, in particular by a pump 56.

By contrast, FIG. 15 reveals that the amount of liquid led away into the interior 32 of the applicator roller 1' through the perforations 30 can also be collected in the interior by a suitable receptacle 58 which, for example, rests on the inner cylindrical or jacket surface 36' of the applicator roller 1'. The liquid 60 contained in the receptacle 58 can then be led away, for example in the axial direction, from the interior 32 of the applicator roller 1', for example through the end sections or the bearing journals of the applicator roller 1', and in particular fed to a liquid circuit again.

I claim:

1. An applicator roller system, comprising:

an applicator roller, including:

a hollow interior;

a roller jacket enclosing said hollow interior and having an outer cylindrical surface for picking up a liquid and, at least to some extent, for transferring the liquid;

said roller jacket being formed with at least one perforation for guiding excess liquid into said hollow interior;

a dip trough;

a rotating element disposed upstream of said applicator roller in a liquid travel direction; and said applicator roller serving for scooping up the liquid from said dip trough by said outer cylindrical surface of said roller jacket or for picking up the liquid from said rotating element.

2. The applicator roller system according to claim 1, wherein said applicator roller further comprises a plurality of axial active regions, said roller jacket being formed with a plurality of perforations in addition to said at least one perforation, each of said plurality of axial active regions having at least one of said perforations.

3. The applicator roller system according to claim 2, wherein said perforations are offset in said roller jacket in circumferential direction and in axial direction and some of said perforations at least partly overlap common axial regions.

4. The applicator roller system according to claim 3, wherein said perforations are linear perforations.

5. The applicator roller system according to claim 4, wherein said perforations have a length of less than 50 mm and a width of less than 1 mm.

6. The applicator roller system according to claim 1, wherein said applicator roller further comprises absorbent material in said hollow interior.

7. The applicator roller system according to claim 6, wherein said absorbent material is selected from the group consisting of sponge-type material and a sponge body.

8. An applicator and element assembly, comprising:

an applicator roller including a hollow interior, and a roller jacket enclosing said hollow interior and having an outer cylindrical surface for picking up a liquid and, at least to some extent, for transferring the liquid, said roller jacket being formed with at least one perforation for guiding excess liquid into said hollow interior; and a rotating element disposed downstream of said applicator roller in a liquid travel direction and defining an inlet wedge between said applicator roller and said rotating element, said rotating element being selected from the group consisting of a roller, a cylinder and a continuously onward moving element selected from the group consisting of a material web and a paper web;

the liquid being selected from the group consisting of water, dampening solution, silicone oil emulsion and ink;

the excess liquid to be guided into said hollow interior from an accumulation of the excess liquid in the inlet wedge;

a dip trough;

another rotating element disposed upstream of said applicator roller in the liquid travel direction; and said applicator roller serving for one of scooping up the liquid from said dip trough by said outer cylindrical surface of said roller jacket, and for picking up the liquid from said another rotating element.

9. The assembly according to claim 8, wherein the excess liquid to be guided into said hollow interior of said applicator roller is at least to some extent feedable to said dip trough through said at least one perforation.

* * * * *